US008287961B2

(12) United States Patent
Hill et al.

(10) Patent No.: US 8,287,961 B2
(45) Date of Patent: Oct. 16, 2012

(54) THERMAL DIRECT PRINTING DISSOLVING PAPER

(75) Inventors: Stephen C. Hill, Perrysburg, OH (US); Theodore J. Rusachen, Loretto (CA)

(73) Assignees: CMC Group, Inc., Bowling Green, OH (US); Consolidated Converting, Inc., Ontario (CA)

( * ) Notice: Subject to any disclaimer, the term of this patent is extended or adjusted under 35 U.S.C. 154(b) by 603 days.

(21) Appl. No.: 12/384,429

(22) Filed: Apr. 3, 2009

(65) Prior Publication Data

US 2009/0252905 A1 Oct. 8, 2009

Related U.S. Application Data

(60) Provisional application No. 61/123,330, filed on Apr. 8, 2008.

(51) Int. Cl.
*B05D 3/02* (2006.01)

(52) U.S. Cl. ..... 427/372.2; 427/384; 427/395; 427/209

(58) Field of Classification Search ..... None
See application file for complete search history.

(56) References Cited

U.S. PATENT DOCUMENTS

| | | | |
|---|---|---|---|
| 3,409,460 | A | 11/1968 | Mitchell et al. |
| 5,478,637 | A | 12/1995 | Tomono et al. |
| 5,506,613 | A | 4/1996 | Helmbold et al. |
| 5,621,983 | A | 4/1997 | Lundemann et al. |
| 5,675,473 | A | 10/1997 | Wright, IV et al. |
| 5,789,031 | A | 8/1998 | Hirabayashi et al. |
| 6,039,356 | A | 3/2000 | Warther et al. |
| 6,503,006 | B1 | 1/2003 | Freedman et al. |
| 6,786,263 | B1 | 9/2004 | Fox, Jr. et al. |
| 6,894,709 | B2 | 5/2005 | Pferrer |
| 2006/0118631 | A1 | 6/2006 | Lubow et al. |
| 2006/0216537 | A1 | 9/2006 | Natsui et al. |

FOREIGN PATENT DOCUMENTS

| | | | |
|---|---|---|---|
| DE | 44 33 006 | C2 | 2/1999 |
| JP | 2004/314623 | * | 11/2004 |

OTHER PUBLICATIONS

Hollingsworth-Vose, "New Water-Dispersible Material Poised to Revolutionize Paper Industry" http://www.hollingsworth-vose.com/news/pr_0804.htm, Apr. 2008, entire document.

International Search Report; Mailed May 22, 2009, for PCT/US09/02097.

* cited by examiner

*Primary Examiner* — Erma Cameron
(74) *Attorney, Agent, or Firm* — MacMillan, Sobanski & Todd, LLC

(57) ABSTRACT

A label has a water dissolvable or water dispersible paper with a coating of a type which can be printed with direct thermal printing. The label is produced by passing a length of such paper with a freshly applied coating of the above type through an oven for drying before the coating has an opportunity to deteriorate the surface of the paper.

12 Claims, 2 Drawing Sheets

THERMAL DIRECT PRINTING DISSOLVING PAPER

CROSS REFERENCE TO RELATED APPLICATION

The present application is based upon and claims the benefit of U.S. Provisional Patent Application Ser. No. 61/123,330 filed Apr. 8, 2008.

The present application is directed to a new paper which is dissolvable or dispersible in water which has properties permitting it to be printed by direct thermal printing and to a method of manufacturing such paper and forming printed labels therefrom.

BACKGROUND OF THE INVENTION

In the food service market, it is desirable to label containers in which food is packaged or temporarily retained in pans or similar containers on a buffet line, with labels which are readily dissolvable in water. For example, when a pan or other container containing food on a buffet line is emptied, it must be washed thoroughly before placing new quantities of food therein. Conventional labels used for such pans or similar containers have been found to be difficult to remove during the process of washing. As a result there has been developed in such food service market, labels which are water dissolvable or water dispersible which can be removed from the pans or similar containers much more readily than the prior conventional labels. Many other markets can benefit from the present invention. For example, poultry is frequently shipped in re-usable containers on which the labels should be removed and re-labeled and subsequently re-printed to set forth the shipping date and other updated information relating to the new shipment.

Water dissolvable labels have been manufactured and sold by the assignee of the present invention for a number of years.

SUMMARY OF THE INVENTION

So far as the inventors hereof have been able to determine, there has not been a commercially viable water soluble/water dispersible label capable of being printed by direct thermal printing. There has been a need in the industry for water soluble/water dispersible labels which can be printed by direct thermal printing.

A significant feature of the present invention is a coating applied to the water dissolvable/dispersible paper. The coating is well suited for applying to water dissolvable/dispersible paper, however. The coating must have the capability of being printed by thermal direct printing and of being dissolvable along with the paper. Thermal direct printing is well known in the art and comprises a plurality of dot-producing heating elements which produce heat in response to energy applied thereto in order to print a series of dots. See for example U.S. Pat. No. 5,506,613 directed to a Thermal Print Head Control For Printing Serial Bar Codes. Direct thermal printing is only effective if the paper to be printed has been coated with a coating which is more adaptable to receiving the printing dots from the thermal print elements than uncoated paper.

Although German Printed Patent Specification DE 44 33 006 discloses a label having water-soluble adhesive on one side of a water-soluble polyvinyl alcohol film or other material (carboxymethylcellulose or carbohyproylcellulose) and a thermosensitive coating mass based on iron stearate on the other side, in order for the label to be water soluble or water dispersible, it is necessary that it be embossed with an embossing calendar so that the thermosensitive layer is provided with penetrating openings that allow the rinsing water to penetrate to the polyvinyl alcohol film and water soluble adhesive.

In contrast, the paper combination of the present invention and the label formed therefrom has a coating which, when applied to the water dissolvable or water dispersible paper, is itself water dissolvable. Accordingly, it is not necessary that water penetrative openings be formed therein. Therefore, such coating can be applied over the entire surface of the paper as a continuous, uninterrupted coating. As a result, such coated paper and labels formed therefrom have all of the surface coated with the coating.

Accordingly, it is an object of the present invention to provide a coating for a water dissolvable/dispersible paper which is well suited to receive images from a direct thermal printer.

As will be appreciated, in applying a coating to a water dissolvable/dispersible paper it is important to design a coating line which coats and dries a coating onto such dissolvable paper without causing any deterioration to the paper. This is particularly true for an aqueous coating, which, if not, properly formulated and applied, could cause partial dissolving of the paper during the coating process.

Accordingly, it is another object of the present invention to provide a coating which may be applied to a water dissolvable/dispersible paper without causing deterioration which would render the paper unsuitable for the intended use. It is a further object of the present invention to provide method and apparatus for applying such coating without deterioration of the water dissolvable/dispersible paper.

Other objects and advantages of the present invention will become apparent to those skilled in the art upon a review of the following detailed description of the preferred embodiments and the accompanying drawings.

IN THE DRAWINGS

DETAILED DESCRIPTION OF THE INVENTION

Figure 1:
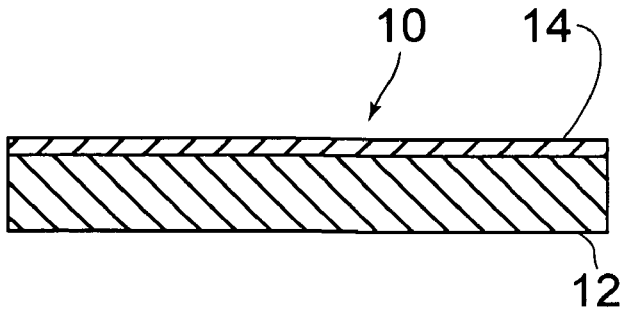
FIG. 1 is a sectional view of a label showing water dissolvable/dispersible paper with a coating applied thereto.

Referring to FIG. 1 there is shown a label 10 comprising a sheet of water dissolvable/dispersible paper 12 and a coating 14 applied in accordance with the present invention. The coating is one which is particularly well suited to receive and clearly show letters, numbers, bar code insignia, or other indicia from a direct thermal printer. A preferred type of coating is one available from Consolidated Converting, Loretto, Ontario, Canada, under its item no. 8957-M. This coating is either white or, if colored, is sufficiently light in color that print or other indicia applied by a direct thermal printer can be readily comprehended.

Figure 2:
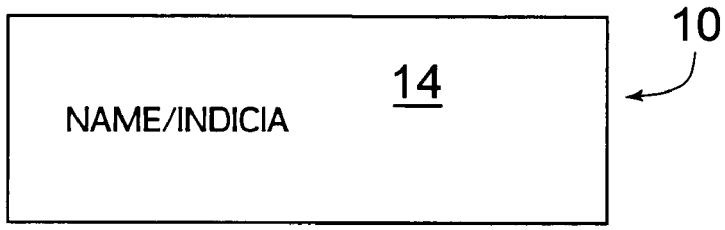
FIG. 2 is a plan view of the label of FIG. 1 following printing with a direct thermal printer.

As can be seen in FIG. 2, the printing has been applied to the coating 14 side of the label 10.

Figure 3:
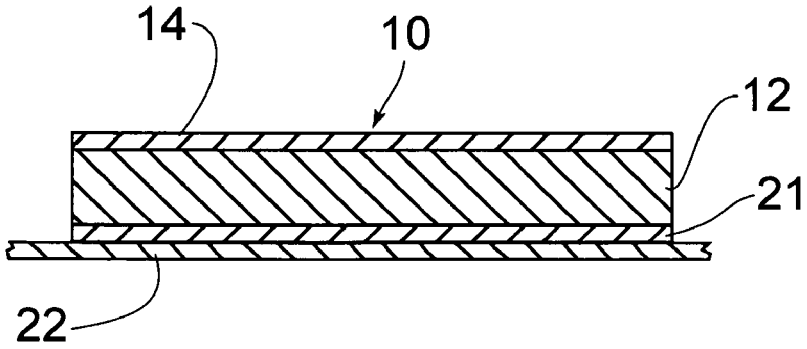
FIG. 3 is a view similar to FIG. 1 but showing a water dissolvable pressure sensitive adhesive on the lower side.

FIG. 3 shows the label 10 having an additional layer of water dissolvable or water dispersible adhesive 21 on the side of the paper 12 opposite the layer of coating 14. The water dissolvable/dispersible adhesive may be one obtained from any of a number of well known suppliers. The label structure of paper 12 with coating 14 on one side and adhesive 21 on the opposite side may have affixed thereto a release layer or liner 22 as is well known in the art of pressure sensitive labels.

Figure 4:
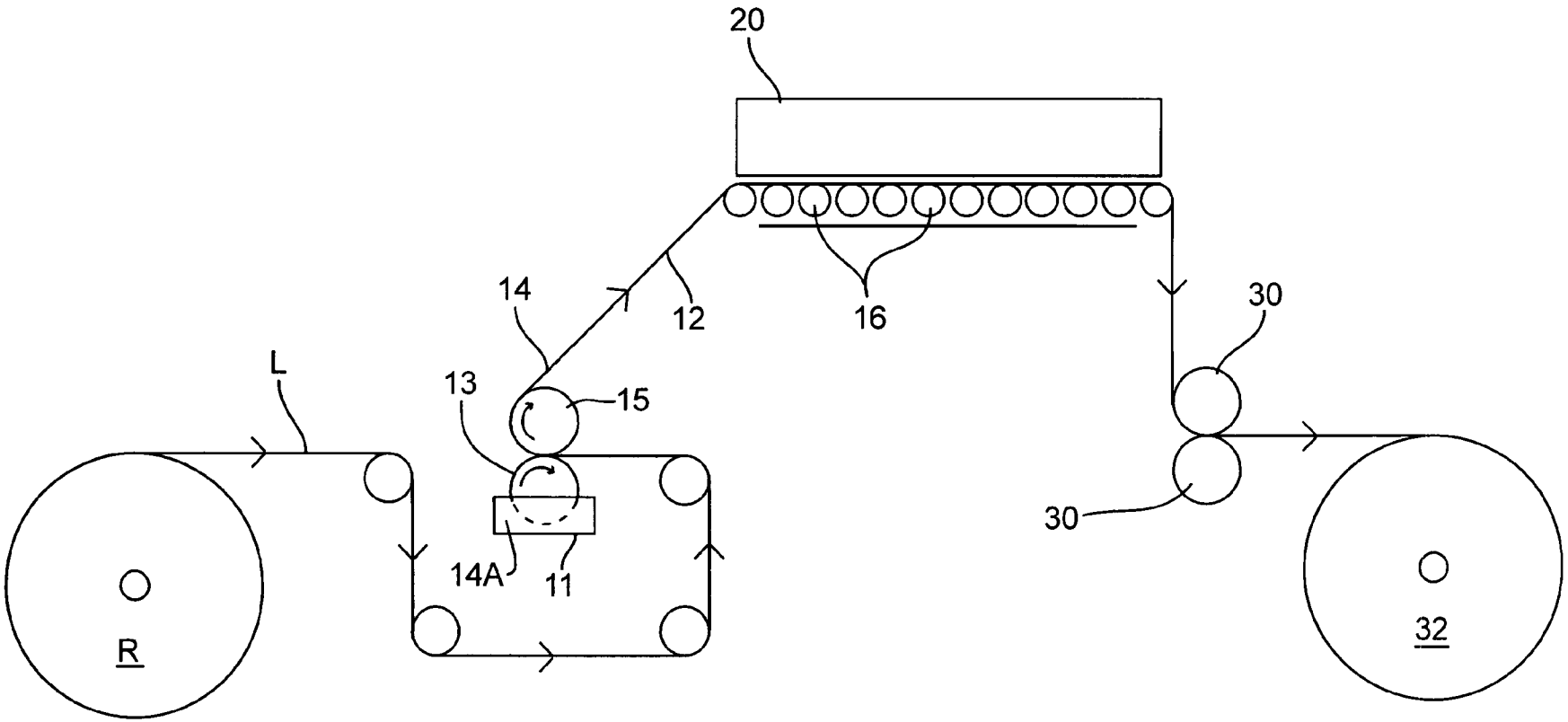
FIG. 4 is a schematic view showing application of a coating to a length of water dissolvable/dispersible paper.

Referring to FIG. 4 there is shown schematically an indeterminate length L of water dispersible/dissolvable paper 12 supported on a conveyor comprising a plurality of closely spaced rollers 16 on which the length L paper is supported and moved in the direction indicated by the arrows in FIG. 4. The paper is a type which is available from Hollingsworth & Vose, East Walpole, Mass., item no. IT 112962. Since the paper 12 is water dissolvable or dispersible, it is important that the application of the coating 14, which may be a water based coating, does not initiate a process of dissolving or dispersing the paper 12 as the coating 14 is applied.

As shown in FIG. 4 the length L of water dispersible paper 12 is being unwound from a supply roll R and fed through a reverse gravure coating station having a tub 11 containing coating material 14A in liquid form, a first roller 13 for transferring a film of such coating material 14A to one side of the paper 12 and a second roller 15 for urging the paper 12 into firm engagement with the first roller 13. As well known in the field of gravure coating/printing a doctor blade maybe provided to wipe off excess coating material 14A from the first roller 13 shortly after such coating material leaves the tub 11 and prior to its reaching the paper 12 at the nip between the first roller 13 and second roller 15 so that a precisely controlled amount of coating material will be applied. The coating 14 is thereby applied to the length L of paper 12 as it passes through the nip between the first roller 13 and the second roller 15.

Shortly thereafter, the paper 12 with the newly applied coating 14 passes through a drying oven 20 while being supported on rollers 16. It is important that the newly coated length of paper 12 be introduced to the oven 20 before the liquid of the water based coating material 14A has an opportunity to deteriorate the surface of the paper 12 to an extent which would adversely affect its quality. This is accomplished by promptly introducing the newly coated paper to the oven 20. For example, the length L of paper 12 is preferably moving over the rollers 16 at approximately 175 feet per minute. The distance from the entrance to the oven 20 from the point of application of the coating to the paper 12 by the first roller 13 is approximately 8 feet, with the result that, the length of time it takes for the paper 12 with a newly applied coating 14 to move from the second roller 15 to the entrance of the oven 20 is less than 3 seconds, which is too short a time period for the water based coating material 14A to adversely affect the paper 12. The oven 20 is maintained at a temperature of 180° F. plus or minus 10° F. which is a temperature lower than that which would activate the coating 14. Any such activating of said coating could cause it to darken and detract from its ability to effectively receive clear images, printing or other indicia from a direct thermal printer. Additionally, the oven 20 is provided with high circulation in order to cause the coating 14 to dry rapidly. The length of the oven is approximately 35 feet which is sufficient to result in a completely dried length of coated paper.

It should be noted that the layer of coating 14 as applied to the paper 12 to form the label with the layer of water dissolvable or dispersible adhesive 21 is itself water dissolvable or dispersible. The dissolvability or dispersibility of the layer of coating adds to the ease of removability of the label 10 from a container using water or water based rinse.

Upon exiting the oven, the coated paper is fed through the nip of a pair of chilled cooling rolls 30 and then fed to a rewind roll 32 for shipping to customers or cut into label size lengths and widths as shown in FIG. 1 for further processing.

If it is desired to have a label 10 with water dissolvable/dispersible adhesive 21 and liner 22 as shown in FIG. 3, the adhesive 21 and liner 22 should be affixed to the paper 12 prior to having the coating 14 applied to the paper 12. In that case, in the description of FIG. 4 setting forth the steps of applying the coating 14, the supply role R would be a roll of a laminate of the paper 12, adhesive 21 and liner 22. All other steps of applying the coating 14 set forth in the description of FIG. 4 are the same except that the coating 14 is applied to the laminate of paper 12, adhesive 21 and liner 22 and not just to the paper 12.

The labels manufactured with the apparatus and method described herein is particularly well suited for use in applications desiring water dissolvable/dispersible labels and the convenience of being printed with direct thermal printing. For example, in the food service industry where food rotation is important, it is desirable to have water dissolvable/dispersible labels to which information may be affixed at the time the label is affixed to the containers. Heretofore it has been necessary to apply such information by hand using a pen or other type of hand manipulated marker. With the labels manufactured according to the present invention, the water dissolvable/dispersible labels 10 can be affixed to the container and a hand operated, direct thermal printer can then affix printing or an appropriate bar code to the label after it is affixed to the container.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A method for forming a label capable of having formed thereon printing or other indicia by direct thermal printing comprising the steps of:

(a) applying directly to a surface of a length of (i) water dissolvable or water dispersible paper or (ii) a laminate of said paper, water dissolvable or water dispersible adhesive and liner, a liquid coating having properties, when dried on said paper, (A) of being water dissolvable or water dispersible and (B) of being suitable for receiving printing or other indicia from a direct thermal printer; and (b) introducing heat to dry said coating on said paper prior to said coating deteriorating said paper surface.

2. A method for forming a label according to claim 1 wherein heat is introduced to said coating within three seconds following said step of applying.

3. A method for forming a label according to claim 1 wherein said step of applying comprises feeding said length of paper or said laminate between the nip of a pair of rollers, one of said rollers having a lower portion thereof in a supply of said liquid coating and delivering a film of said liquid coating to said nip for application to said surface.

4. A method for forming a label according to claim 3 further including the step of delivering said length with said liquid coating to an oven within three seconds of leaving said nip.

5. A method for forming a label according to claim 4 further including the step of maintaining said oven at a temperature in the range of 180° F. plus or minus 10° F.

6. A method for forming a label according to claim 5 further including the step of passing said length with said liquid coating through said oven at a speed to dry said liquid coating without said liquid coating deteriorating said paper.

7. A method for forming a label according to claim 6 wherein said length with said liquid coating is passed through said oven at a speed to avoid darkening said coating and interfere with its ability to receive comprehendible print or other indicia when subjected to direct thermal printing.

8. A method for forming a label according to claim 6 further including the step of passing said length between the nip of a pair of rollers, at least one of which is chilled, after it leaves said oven.

9. A method for forming a label capable of having formed thereon printing or other indicia by direct thermal printing comprising the steps of:

(a) applying directly to one surface of a length of water dissolvable or water dispersible paper, a liquid coating having properties, when dried on said paper (A) of being water dissolvable or water dispersible and (B) of being suitable for receiving printing or other indicia from a direct thermal printer;

(b) affixing to a second surface of said paper water dissolvable or water dispersible adhesive; and (c) thereafter introducing heat to dry said coating on said paper prior to said coating deteriorating said paper.

10. A method for forming a label according to claim 9 further including the step of affixing a liner to said adhesive prior to step (c).

11. A method for forming a label capable of having formed thereon printing or other indicia by direct thermal printing comprising the steps of:

(a) applying to one surface of a length of water dissolvable or water dispersible paper, a layer of water dissolvable or water dispersible adhesive; and (b) affixing directly to a second surface of said paper a liquid coating having properties, when dried on said paper, (A) of being water dissolvable or water dispersible and (B) of being suitable for receiving printing or other indicia from a direct thermal printer; and, (c) thereafter introducing heat to dry said coating on said paper prior to said coating deteriorating said paper.

12. A method for forming a label according to claim 11 further including the step of affixing a liner to said adhesive prior to step (c).

* * * * *

UNITED STATES PATENT AND TRADEMARK OFFICE

CERTIFICATE OF CORRECTION

PATENT NO. : 8,287,961 B2
APPLICATION NO. : 12/384429
DATED : October 16, 2012
INVENTOR(S) : Stephen C. Hill and Theodore J. Russchen It is certified that error appears in the above-identified patent and that said Letters Patent is hereby corrected as shown below:

On the Title Page, Item (75),

"Theodore J. Rusachen, Loretto (CA)" should read -- Theodore J. Russchen, Loretto (CA) --.

Signed and Sealed this
Fourth Day of June, 2013

Teresa Stanek Rea
*Acting Director of the United States Patent and Trademark Office*